United States Patent [19]

Lyman

[11] 4,041,627

[45] Aug. 16, 1977

[54] SEQUENTIAL DISPLAY DEVICE

[75] Inventor: George F. Lyman, Weston, Mass.

[73] Assignee: Data Packaging Corporation, Cambridge, Mass.

[21] Appl. No.: 642,298

[22] Filed: Dec. 19, 1975

[51] Int. Cl.[2] ..... G09F 11/12

[52] U.S. Cl. ..... 40/97; 40/100; 40/102

[58] Field of Search ..... 40/96, 96.5, 97, 98, 40/99, 100, 101, 102, 104 R, 32, 35

[56] References Cited

U.S. PATENT DOCUMENTS

| | | | |
|---|---|---|---|
| 170,539 | 11/1875 | Evans | 40/100 |
| 172,328 | 1/1876 | Lauer | 40/98 |
| 263,974 | 9/1882 | Shirk | 40/100 |
| 483,312 | 9/1892 | Rudolph | 40/96 |
| 2,755,578 | 7/1956 | Glacius | 40/35 |
| 3,292,285 | 12/1966 | Kitayama | 40/102 X |

*Primary Examiner*—John F. Pitrelli
*Attorney, Agent, or Firm*—Wolf, Greenfield & Sacks

[57] ABSTRACT

A picture display device includes a plurality of generally rectangular frames hinged together, edge-to-edge in an endless series. The frames can be folded into an arrangement defining a compact pack from which a pair of frames project in an inverted-V display position. The assembly of frames is detachably mountable to a support device and in a manner in which manual rotational movement of the upwardly projecting pair of frames from the display position back toward the pack automatically raises another pair of frames to the display position.

9 Claims, 4 Drawing Figures

FIG. 2
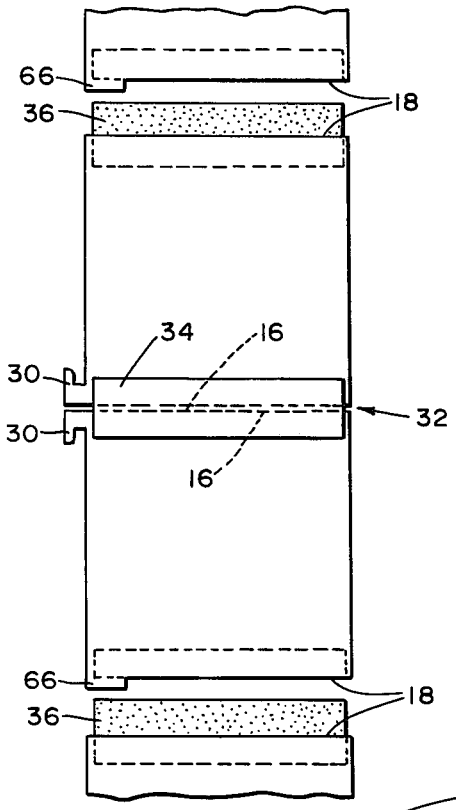
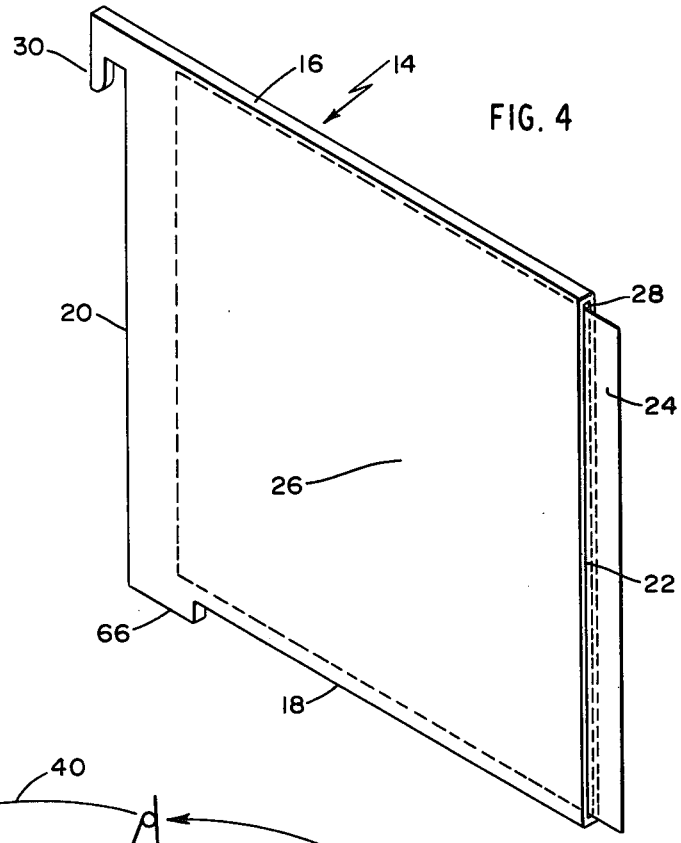
FIG. 4
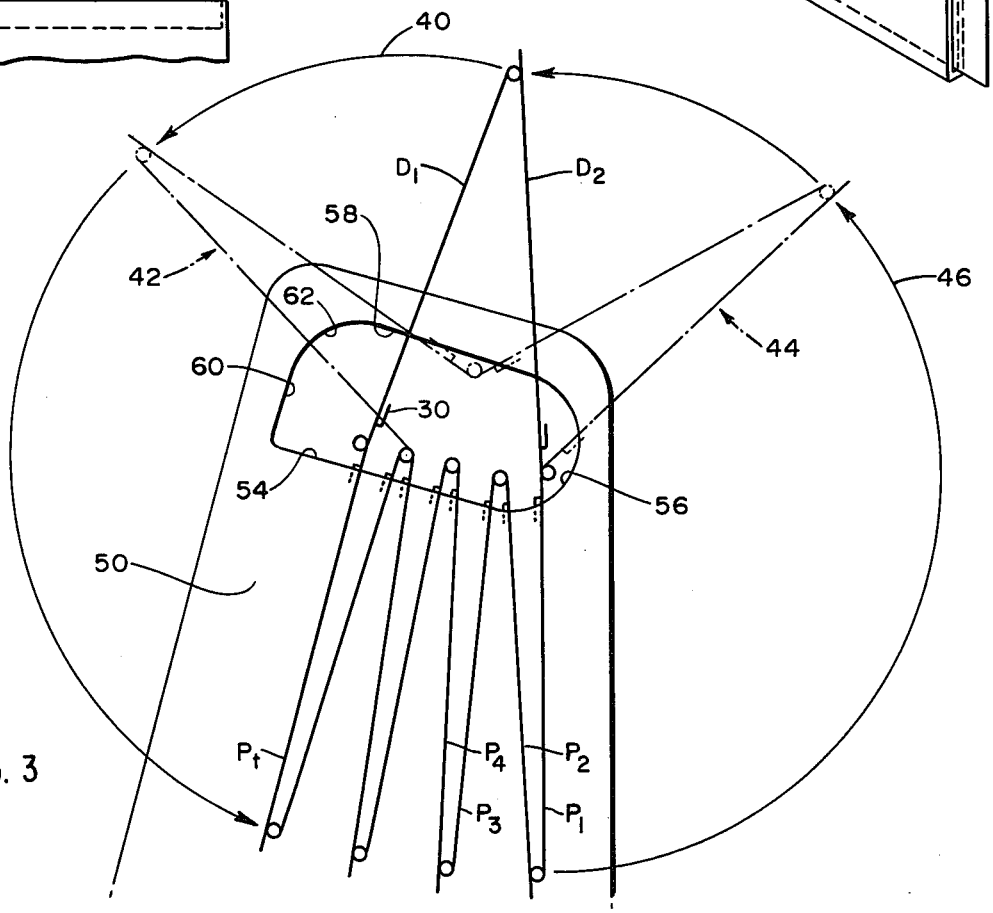
FIG. 3

SEQUENTIAL DISPLAY DEVICE

BACKGROUND AND SUMMARY OF THE INVENTION

This invention relates to displays for photographs or the like and, more particularly, to an arrangement for storing a substantial number of photographs in a compact configuration and in readiness for serial display.

The invention employs a plurality of picture carrying frames which are serially hinged together, edge-to-edge, in an endless array. The hinges are arranged to enable the frames to be folded against each other in an accordian-like pack with an adjacent pair of the frames extending upwardly from the pack in an inverted-V, display configuration. Each of the frames is constructed to carry and display a picture or other flat, sheet-like article. The arrangement enables the pair of upwardly extending frames to be pivoted downwardly toward the trailing end of the pack which also simultaneously and automatically draws the next pair of frames upwardly from the leading end of the pack to the inverted-V display position. The frames are supported and mounted for such movement by hooks extending transversely from the frames and which engage a ledge formed on a support stand. Each of the frames has one such hook extending transversely from one of its unhinged sides, in proximity to one of its hinged sides. The hooks are arranged so that all of the hooks in the frames in the pack will be in alignment and will overhang and engage the ledge on the support stand. As the frames are advanced from the pack to the display position, their hooks automatically disengage from the ledge and re-engage the ledge when they are returned to the rear end of the pack. The hooks and support stand are arranged so that the entire array of frames can be removed easily from the stand and replaced with a different array of frames, perhaps being different pictures or other sheet-like materials to be displayed.

It is among the objects of the invention to provide an improved picture display device which is capable of storing a substantial number of photographs or other sheet-like materials to be displayed.

Another object of the invention is to provide a display device of the type described which enables two frames to be displayed at the same time.

A further object of the invention is to provide a display device of the type described in which the plurality of frames are serially connected, end-to-end in an endless array.

Another object of the invention is to provide a display device of the type described which enables a plurality of pictures or the like to be displayed at the same time.

Still another object of the invention is to provide a display device of the type described in which movement of a pair of frames from the display position automatically causes the succeeding pair of frames to be advanced to the display position.

DESCRIPTION OF THE DRAWINGS

The foregoing and other objects and advantages of the invention will be understood more fully from the following further description thereof, with reference to the accompanying drawings wherein:

FIG. 2 is an illustration of a number of frames in series illustrating the manner in which the frames are hinged;

FIG. 3 is a diagrammatic side elevation of the device showing the manner in which the frames are presented automatically and in sequence; and FIG. 4 is an illustration of a frame.

DESCRIPTION OF THE PREFERRED EMBODIMENT

Figure 1:
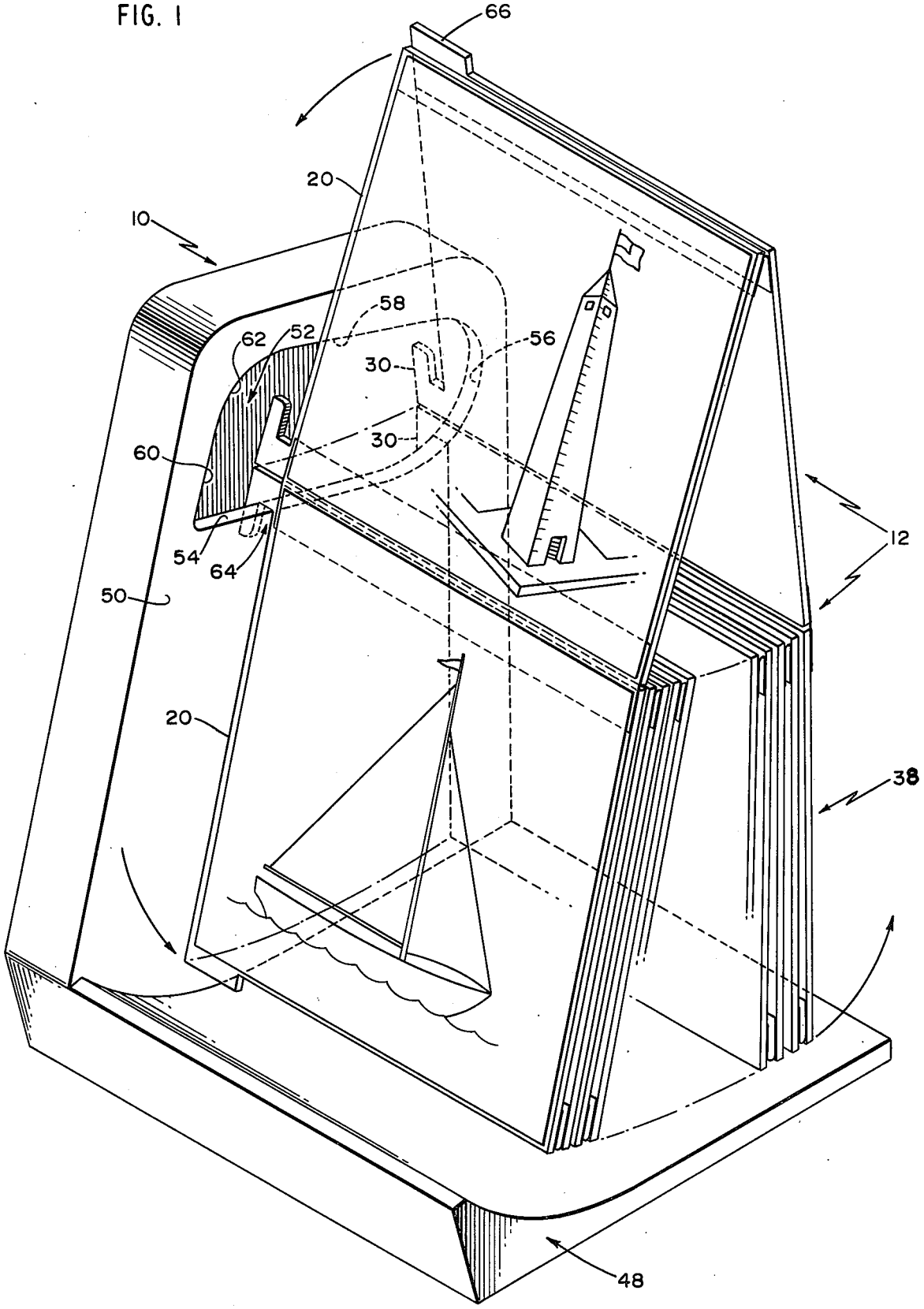
FIG. 1 is an illustration of the device is use.

FIG. 1 shows the device which includes a support stand indicated generally by the reference character 10 and a frame array, indicated generally by the reference character 12, which is detachably supported on the stand 10. The frame array 12 is formed from a plurality of frame sections 14, an individual frame section 14 being shown more fully in FIG. 4. The frame sections 14 are arranged serially and are connected at their adjacent edges, end-to-end in an endless configuration. Each of the frames may be considered as having an inner edge 16, an outer edge 18 and a pair of side edges 20, 22. The frames 14 are flat and of relatively thin construction to enable a substantial number of them to be stacked one against the other as will be described. Each of the frames 14 preferably is made from a transparent plastic material and is constructed to receive a photograph or other thin sheet-like item 24 which can be displayed through the transparent face 26 of the frame 14. In the embodiment suggested in FIG. 4, the frame section may be formed to define a slot 28 open at the side edge 22 of the frame 14 to removably receive a photograph 14 or the like. The frame sections may be built up from a pair of molded plastic sheet-like sections or by other construction techniques which will be apparent to those skilled in the art.

Each of the frames 14 includes an integral L-shaped hook 30 which extends transversely from the corner defined by the inner edge 16 and the side edge 20. The inner edges 16 of adjacent frames are hingedly connected to each other as are the adjacent outer edges 18 of adjacent frames as suggested in FIG. 2. The hinged joints 32 may be defined by transparent tape strips which may be attached to the frames on alternate sides of the endless series of joints so that each adjacent pair of frame sections will tend to hinge in opposite directions. Thus, as illustrated in FIG. 2, the tape strip will define an inside hinge while the tape strips 36 will define outside hinges arranged to facilitate hinging of the frame sections in an opposite direction.

The foregoing hinge configuration for successive frame sections enables the sections to be arranged in an endless configuration shown in FIGS. 1 and 3 in which all but one pair of the connected sections 14 may be arranged in an accordion-like pack as suggested at 38 in FIG. 1. The pack 38 may be considered as having a leading end (which is in full view in FIG. 1) and a trailing end (which is obscured in FIG. 1). With all but two of the frame sections collapsed to the accordion-like configuration, the remaining pair of frame sections, which connect the leading and trailing ends of the pack, extend upwardly from the pack in an inverted-V shaped attitude as shown. It may be noted that with the frames so arranged, all of the outer edges 18 will extend outwardly whereas all of the inner edges 16 are disposed more inwardly, near the center of the array 12. As will be described, the hooks 30, cooperate with the stand 10 to enable the frames to be presented serially and in a manner in which shifting of one pair of frames from the display position automatically brings the next pair of frames to the inverted-V, display position.

The operation of the device is illustrated somewhat diagrammatically in FIG. 3 in which the rearwardmost frame in the pack may be considered as being in the position identified at $p_1$, the next frame in the pack as $P_2$, etc., and with the last frame at the trailing, forward end of the pack being identified at $P_r$. The frames in the display position indicated in solid at FIG. 3 may be identified as $D_1$ and $D_2$. When the frames 14 which are in the display position $D_1$, $D_2$ are urged forwardly and downwardly, as suggested by the arrow 40, to the position shown in phantom and identified by reference character 42, this motion will draw the leading pair of frames from the positions $P_1$, $P_2$ in the pack upwardly toward the display position as suggested at 44 and indicated by the arrow 46. The frames are advanced to rotate the previously displayed frames to the forward, trailing end of the pack which brings the next successive pair of frames from the intermediate position suggested at 44 to the display position $D_1$, $D_2$. All of the pairs of frames in the pack thus advance toward the leading end of the pack to the position $p_1$, $p_2$ and in readiness to be rotated upwardly to the display position $D_1$, $D_2$.

The array of frames is mounted to the support stand 10 for the foregoing movement by the hooks 30. The stand 10 includes a base 48 and a support wall 50 extending upwardly from a side edge of the base. The support wall 50 has an opening 52 which is formed to define a substantially continuous edge including a lower ledge portion 54 which is inclined slightly downwardly and rearwardly. The rear region of the lower ledge portion 54 merges smoothly into an upwardly curving arcuate rear portion 56. The upper end of the arcuate rear portion 56 of the edge of the opening 52 merges smoothly into an upper portion 58 which extends forwardly and generally parallels the lower ledge portion 54 of the opening. The front edge 60 of the opening merges smoothly at an arcuate region 62 into the upper portion 58.

The frames are arranged so that the hooks 30 of the frames in the pack will be in alignment with each other and will define a substantially continuous channel suggested at 64 in FIG. 1, which can be hooked over the lower ledge portion 54 of the opening 52. The width of the channel 64 defined by the hooks is just slightly greater than the thickness of the inwardly facing wall 50 so that the side edges 20 of the frames can rest against the wall 50. As shown in FIG. 1, the hooks 30 on the pair of frames $D_1$, $D_2$ in the display position extend upwardly and do not engage the edge of the opening 52. As the frames in the display position $D_1$, $D_2$ are rotated forwardly toward the trailing end of the pack, the hooks of those frames will engage the lower ledge portion 54 to aid in supporting the pack. As the pair of frames which were in the leading position $P_1$, $P_2$ in the pack are advanced upwardly to the display position, their hooks 30 advance from the rearward end of the ledge portion 54 to the arcuate portion 56 and then disengage and assume the attitude shown in FIG. 1. The downwardly and rearwardly inclined attitude of the lower ledge portion 54 enables the pack to gravitate toward the rearwardly disposed arcuate edge 56.

The height of the opening 52, as measured from the lower ledge portion 54 to the upper portion 58 of the opening is greater than the total height of a pair of separated, spread-apart hooks 30 so that the entire frame array 12 an be simply lifted off of the lower ledge portion 54 of the opening 52 and removed from the support stand 10. The array of frames may be replaced by a different array of like construction by simply inserting the hooks through the opening 52 and permitting the channel 64 defined by the aligned hooks of the frame pack to engage the ledge portion 54 of the opening 52.

It should also be noted that the advancement of the frames can be in a reversed direction if desired. In this mode of operation, as the frames in the display position $D_1$, $D_2$ are rotated toward the rearward, then trailing end of the pack, the hooks 30 of those frames will engage the arcuate rear portion 56 of the edge of the opening 52 and, when those frames have been rotated fully to the trailing end of the pack, their hooks will rest on the portion 54 of the ledge to aid in supporting the pack. As the pair of frames which were in the then leading position in the pack are advanced upwardly to the display position, their hooks 30 disengage from the lower ledge portions 54 and will assume the attitude shown in FIG. 1.

If desired, alternate of the frame sections may be formed to include a tab 66 to facilitate manual advancement. The tab 66 preferably extends from the outer edge 18 and is located at the corner defined by the outer edge 18 and the side edge 20. When the tabs 66 are employed, they should be located so that they do not interfere with the action of the hinges connecting the outside edges 18 of adjacent frames.

The frame sections 14 as well as the support stand 10 may be made from a variety of materials, with plastic being preferred. Also, while the illustrative embodiment is described in which the frames have a slot formed therein to receive a photograph or other thin sheet-like item, other flat types of display frame sections may be employed. For example, frame sections 14 may be simple flat sheets to which photos or the like may be adhesively attached directly to a face of the section 14. If the section is transparent, the photograph or sheet may be attached to the inwardly facing surface of the section.

It should be understood from the foregoing description of the invention is intended merely to be illustrative thereof and that other embodiments and modifications may be apparent to those skilled in the art without departing from its spirit.

Having thus described the invention, what I desire to claim and secure by Letters Patent is:

1. A device for presenting a series of photographs or the like in endless sequence comprising:

a plurality of generally flat, substantially rectangular panels hinged together, edge-to-edge in an endless sequence, said panels being hinged in a manner to enable all but two of the panels to be arranged in a pack of accordian-like configuration, said two remaining of said panels defining a self-supporting, V-shaped configuration and extending away from the pack in a display position;

each of the panels having an inner edge, an outer edge and a pair of side edges, the inner edges of adjacent panels being hinged to each other and the outer edges of adjacent panels being hinged to each other, hinges connecting the adjacent inner edges being constructed and arranged to enable the panels to be hinged in one direction and the hinges connecting the outer edgess of adjacent panels being constructed and arranged to permit hinging in the opposite direction, and means for supporting the panels in a manner to enable said pair of panels to be pivoted toward an end of the pack and, in response thereto, to cause the leading pair of panels at the opposite end of the pack to be pivoted away from the pack and to be advanced to the display position.

2. A device as defined in claim 1 wherein the hinges comprise transparent tape strips.

3. A device as defined in cliam 1 wherein each of the panels is formed from a transparent material.

4. A device as defined in claim 3 wherein each of the panels includes a slot formed therein receptive to a flat sheet to be displayed, the slot having an opening at one of the side edges of the panel.

5. A device for presenting a series of photographs or the like in endless sequence comprising:

a plurality of generally flat, substantially rectangular panels hinged together, edge-to-edge in an endless sequence, said panels being hinged in a manner to enable all but two of the panels to be arranged in a pack of accordian-like configuration, said two remaining of said panels defining a V-shaped configuration and extending away from the pack in a display position;

means for supporting the panels in a manner to enable said pair of panels to be pivoted toward an end of the pack and to cause the leading pair of panels at the opposite end of the pack to be pivoted away from the pack and to be advanced to the display position;

said means for supporting the frames comprising:

at least half of the frames each having a hook extending from a side edge thereof, the hook of the frames in the pack generally defining a channel which extends along said side edge; and an upstanding wall having a ledge formed thereon, the ledge being dimensioned to enable the channel defined by the hooks to be engaged by the channel.

6. A device as defined in claim 5 further comprising:

said ledge having a forward portion which is inclined slightly downwardly and rearwardly and a rearward portion which extends upwardly.

7. A device as defined in claim 6 further comprising:

the upstanding wall including an opening therein, the opening being defined in part by the ledge, the opening being further defined by a forward edge which extends from the forward region of the ledge upwardly, the upper end of the forward edge and the upper end of the rearward edge of the ledge being defined by an upper edge which substantially parallels the forward portion of the ledge.

8. A device as defined in claim 7 further comprising:

the upstanding wall being formed as part of an L-shaped stand having a base secured to the bottom of the upstanding wall to support the wall.

9. A device as defined in claim 5 further comprising:

alternate of the panels having tabs extending from the outer ends thereof.

* * * * *